United States Patent [19]

Jerberyd

[11] Patent Number: 4,522,129

[45] Date of Patent: Jun. 11, 1985

[54] DEVICE FOR CHARGING DRILLHOLES

[75] Inventor: Leif Jerberyd, Handen, Sweden

[73] Assignee: Nitro Nobel AB, Gyttorp, Sweden

[21] Appl. No.: 264,556

[22] Filed: May 18, 1981

[30] Foreign Application Priority Data

May 28, 1980 [SE] Sweden ..... 8003974

[51] Int. Cl.[3] ..... B66F 1/00; H02G 1/08

[52] U.S. Cl. ..... 104/138 G; 102/312; 102/313; 175/4.5; 254/106; 254/134.6; 299/13

[58] Field of Search ..... 15/104.05, 104.16; 33/178 F; 72/466; 73/40.5 R; 104/138 R, 138 G, 155; 105/365; 118/105, 254, 408, DIG. 10; 254/106, 134.5, 134.6; 102/312, 313; 175/4.5; 299/13

[56] References Cited

U.S. PATENT DOCUMENTS

| | | | |
|---|---|---|---|
| 690,594 | 1/1902 | Lonergan | 254/134.6 |
| 901,159 | 10/1908 | Dieter et al. | 254/134.6 |
| 1,128,746 | 2/1915 | Bierce | 254/134.6 |
| 4,050,384 | 9/1977 | Chapman | 104/138 G |

FOREIGN PATENT DOCUMENTS

| | | | |
|---|---|---|---|
| 1270642 | 6/1968 | Fed. Rep. of Germany | 254/134.6 |
| 1044201 | 9/1966 | United Kingdom . | |
| 117896 | 1/1958 | U.S.S.R. | 102/313 |

*Primary Examiner*—Robert B. Reeves
*Assistant Examiner*—David F. Hubbuch
*Attorney, Agent, or Firm*—Shlesinger, Fitzsimmons & Shlesinger

[57] ABSTRACT

A two-piece, telescopic climber, which is insertable into a drillhole behind cylindrically shaped explosive charges, alternately advances one and then the other of its two telescopic pieces in the direction of the drill hole thereby to urge the charges forwardly thereof into the hole. Each piece has thereon means which expands outwardly against the wall of the drill hole to hold that piece stationary while the other piece advances. At least one of the two pieces can be removed from the drill hole to be used repeatedly.

5 Claims, 10 Drawing Figures

14
26
24
38
10
20
16
12
22
18
30
28
20
38
18

DEVICE FOR CHARGING DRILLHOLES

The present invention is concerned with a device for charging drillholes with explosive.

In recent years it has become increasingly common in so-called production blasting underground to use drillholes of larger diameters. For example, drillhole diameters in the range 75–115 mm are no longer unusual. The primary advantages of these wider drillholes are superior accuracy of drilling and lower overall cost, due among other things to the smaller number of holes. However, the smaller number of holes entails very stringent demands on charging and detonation.

There is as yet no properly developed technique and no special equipment for the efficient charging of large rising drillholes, and therefore mining methods are still based on the technology used in connection with downward holes.

With conventional equipment it is quite difficult to charge large rising holes when using so-called bulk explosives. In one known method liquid explosive, termed slurry, is pumped into the drillhole through a plug of cement in the mouth thereof, provided with holes for the introduction of explosive and, if necessary for a drainage hose, so that the level of explosive progressively rises in the drill hole. The use of a plug in the mouth of the drillhole is also a known procedure for charging ANFO explosives. In this case a plastic tube passes through the plug up to the region of the bottom of the drillhole, and the slenderer charging tube is inserted into the said thicker tube until the ends of both tubes are level. When the explosive is blown in through the charging tube it will fall back like snow inside the drillhole and settle around the thicker tube. When charging is completed the charging tube, at least, can be recovered from the hole.

Neither of the above-described methods offers any certainty as to the conditions inside the drillhole when it is time for firing.

In drillholes of diameter less than 100 mm it is a known practice to use pneumatic charging devices for charging plastic explosives in cartridges of paper or plastics film. However, if a charger of this type were used for cartridges with larger than the current 40 mm diameter the charging tubes would be thick and inconvenient.

It is one of the principal objects of the invention to provide a device which makes it possible to charge drillholes of diameter exceeding approximately 40 mm simply and with a high degree of reliability, without using a charging tube. It has been found possible to achieve this by incorporating in the device a climbing unit or "climber" for applying the explosive in the desired place in the drillhole. The said climber is provided with powered locomotive means designed to propel the climber in the desired direction in the drillhole, in which process pressure means incorporated in the climber press against the walls of the drillhole to stabilize the climber inside the hole and prevent it from dropping downwards therein. The climber preferably comprises two parts capable of motion relative to each other, and enabling the climber to extend and contract while the pressure means press against the walls of the hole. In the preferred form of the invention both the locomotive means and the pressure means may be pneumatically operated. The locomotive means may further comprise driving wheels desinged to be pressed away from the body of the climber against the walls of the hole during use.

The invention will now be described in more detail in the form of a number of preferred embodiments thereof, with reference to the accompanying drawings.

Figure 1:
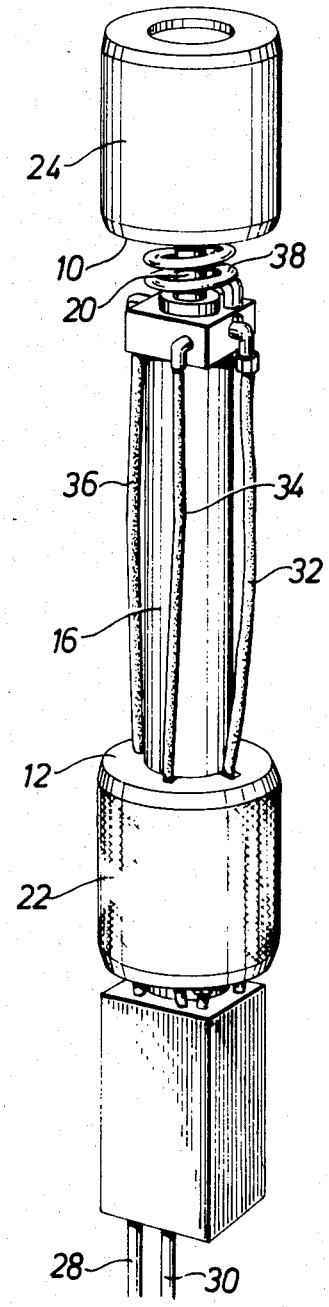
FIG. 1 is a perspective view of a preferred embodiment of a climber designed in accordance with the principles of the invention.
Figure 2:
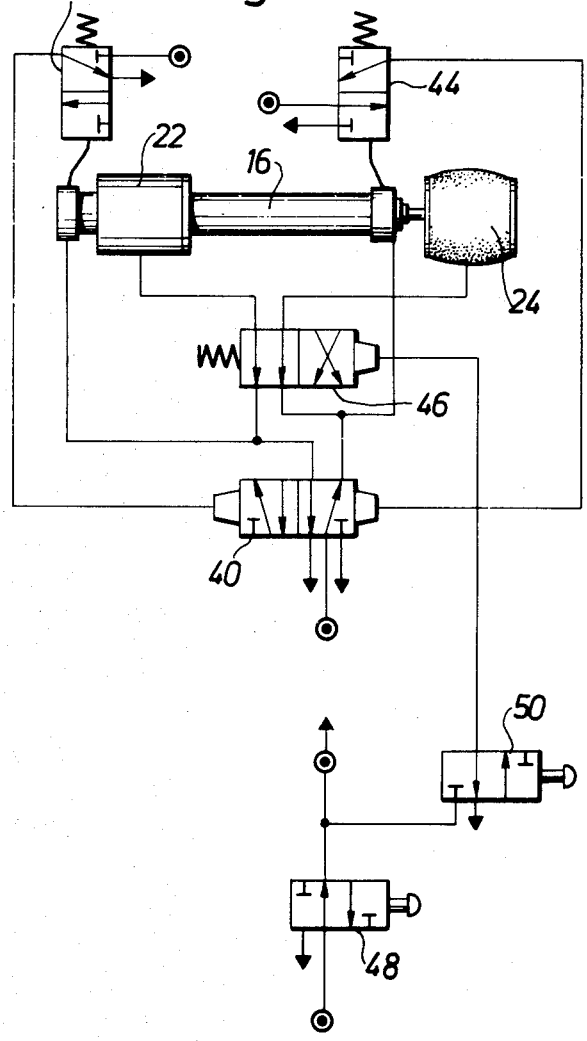
FIG. 2 is an outline diagram which in conjunction with the drawings illustrates the mode of operation of the climber shown in FIG. 1.

FIGS. 3*a*–3*d* are four sectional views through the center of a drillhole containing the climber illustrated in FIGS. 1 and 2, and illustrating the climber in four different climbing steps in a drillhole.

Figure 4:
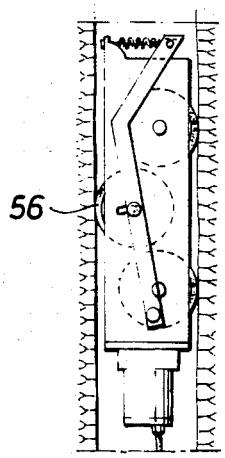
Figure 5:
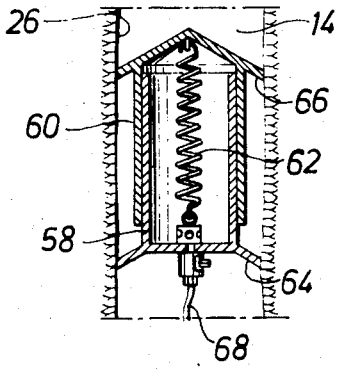
Figure 6:
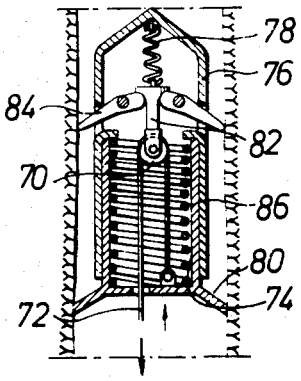

FIGS. 4 to 6 show in plan, and partly in cut away views, modifications of climbers designed on the principles of the invention.

Figure 7:
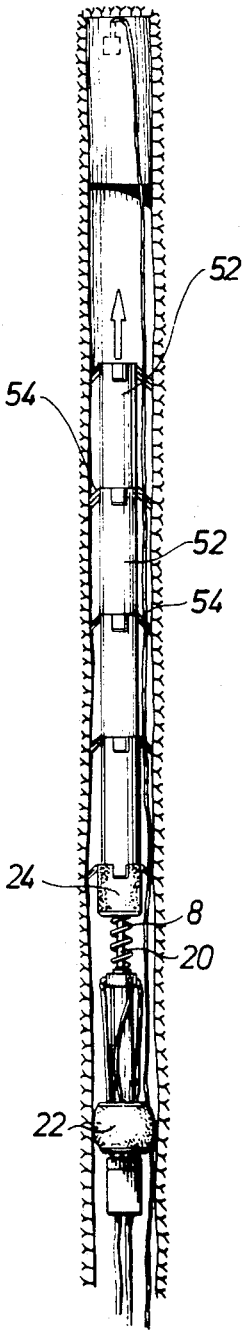

FIG. 7 shows in section, from the side, a climber of the type illustrated in FIG. 1, used as a conveying device for pushing explosive charges up a drillhole.

The climber illustrated in FIGS. 1 and 3 comprises two parts 10, 12 which are capable of motion relative to each other and designed to enable the climber to extend and contract in the course of locomotion inside a drillhole 14. The two parts 10, 12 are associated with a double-acting air cylinder, both the cylinder 16 and the piston 18, 20 which reciprocates therein being provided with pneumatic expansion means 22, 24. The expansion means consist of inflatable elastic bodies which by reason of their large active surface areas provide good adhesion against the wall 26 of the drillhole and are capable of retaining relatively heavy loads (charges weighing up to 20 kg can occur) while inflated under comparatively low pressures. A plurality of air lines 28–38 from a compressed air source (not shown) pass into the rear of the climber cylinder 16, providing communcation with the interior of the inflatable bodies and with the corresponding spaces on either side of the piston 18.

Inside the climber there are four valves. The reciprocating motion of the cylinder is obtained by means of valve 40, which is switched by impulse valves 42 and 44, which in turn are actuated mechanically by the piston rod 20 at its end positions. The expansion means 22, 24 are also supplied with air via valve 40, to enable the cylinder to describe a linear motion. Valve 46 is included in the system to make it possible to change the direction of motion of the climber.

Two control valves 48, 50 are provided for remote operation of the climber. Valve 48 is the main air supply valve to the climber (starting and stopping function), and valve 50 determines it direction of motion (forward/backward function).

The new charging device uses the drillhole 14 itself as a conveying route. It is preferably introduced into the hole with the aid of a tube (not illustrated) applied to the mouth of the drillhole as a continuation thereof. The said tube should be provided with opening means on one side to allow the insertion of charges ahead of the climber.

Figures 3A, 3B, 3C, 3D:
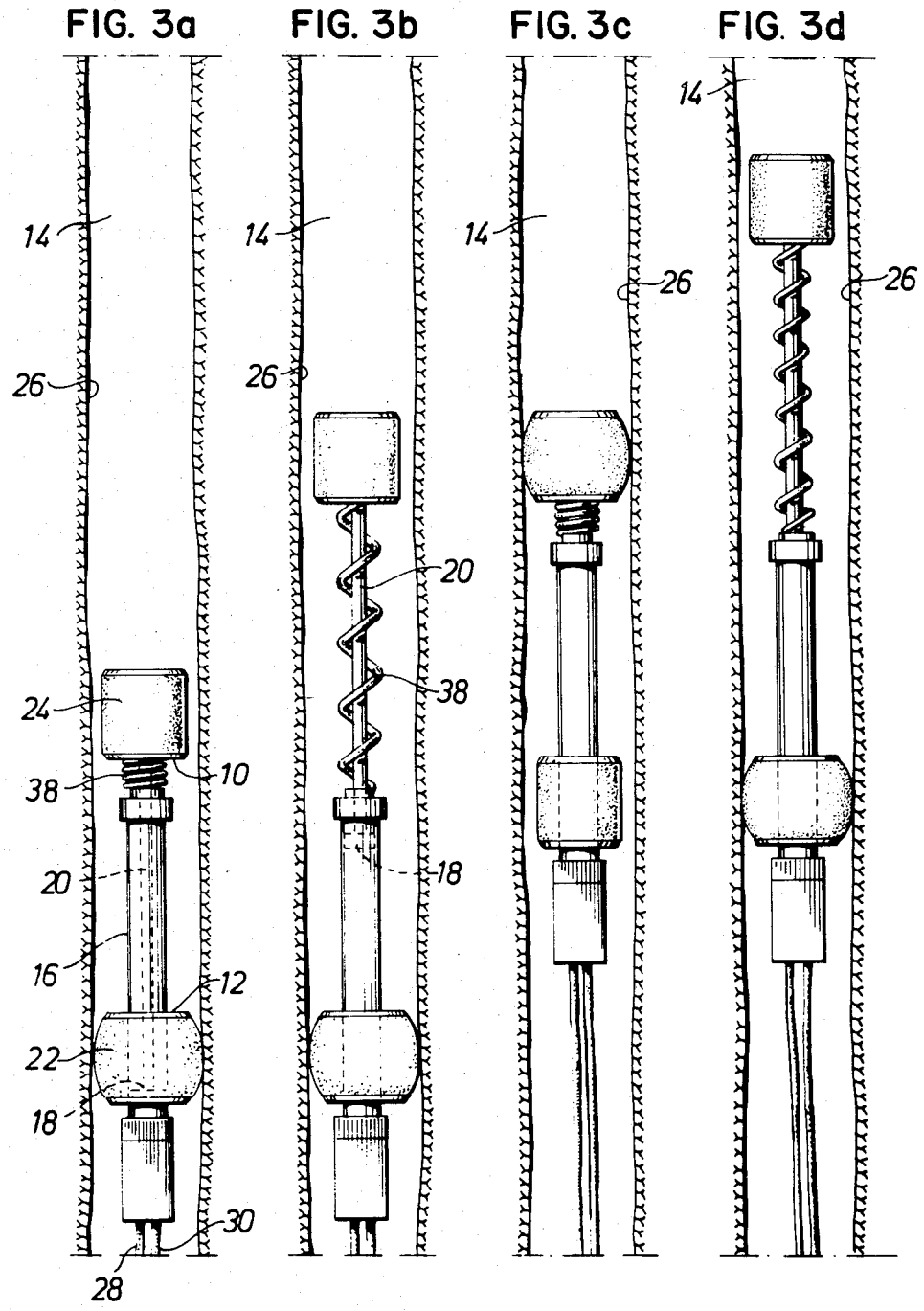

FIG. 3*a* shows the starting position of the climber inside the drillhole 14. In this position the lower expansion means 22 retains the climber in the hole by pressing against the wall 26 thereof. In the position shown in FIG. 3*b* the lower expansion means 22 is still inflated. Air has now been fed into the lower part of the cylinder 16, forcing the piston rod 20 and the expansion means 24 associated therewith upwards in the drillhole 14. In FIG. 3*c* the switching of the air supply as between the expansion means 22, 24 and the cylinder 16 is reversed. The climber is now retained in the hole by the upper expansion means 24. By the feeding of air into the upper end of the cylinder 16 the latter has been forced upwards after its expansion means 22 has been deflated. In FIG. 3*d* the air has once again been switched between the expansion means 22, 24 and the cylinder and the operating cycle repeats.

The above-described climber is primarily intended for pushing charges ahead of it up a drillhole 14. It is evident from the preceeding that the climber is also capable of climbing down the hole, and it can naturally propel itself in holes of various inclinations. The construction of the climber is also such that it is capable of a tamping action, which makes it possible to control the charge density in the drillhole.

The charges 52 pushed ahead of the climber as illustrated in FIG. 7 are equipped with arresting means 54 in the form of collars or similar devices to prevent the charges from falling down the drillhole when the climber is retracted after charging.

FIG. 4 shows a modified design of climber wherein propulsion is by three rubber-clad wheels 56. In the example illustrated two of the wheels are positioned on one side of the climber and one on the diametrically opposed side thereof. The arrangement is such that the wheels are forced apart and get a purchase on the walls of the drillhole. Locomotion is by means of a motor (not illustrated) powered by pressure fluid. Electrical energy or similar can of course also be used as power source. The motor is used to drive one or more of the wheels. While the climber is in motion in the drillhole the wheels will turn against the walls of the hole, but thanks to a certain resilience of the wheel mountings the climber will not be impeded in its motion by roughness of the wall. The wheel-driven climber, like the climber described earlier, is specially designed for pushing charges ahead of it up the drillhole.

The climber illustrated in FIG. 5 comprises two telescoping parts 58, 60 connected by means of a helical spring 62. Like the device of FIGS. 1, 2, 3*a–d* and 7, the climber is powered by compressed air, making it possible to propel the climber by means of extending and contracting movements. arresting means 64, 66 in the form of flexible plastics collars are provided on both the forward and the rear part of the climber. When compressed air is supplied via line 68 the lower part 58 of the climber is retained in the drillhole 14 by the arresting means 64. At the same time the upper part 60 is forced upwards, thus tensioning the helical spring 62. During the rapid evacuation of the air from the climber the upper part 60 is retained by its arresting means 66 and the lower part 58 is drawn up by the spring 62. After a charge has been placed in the hole 14 the rear part 58 of the climber may, if desired, be detached from the forward part 60 thereof, which constitutes part of the charge. The rear part can be retracted down the drillhole 14 and re-used.

The climber of FIG. 6 is equipped with a block 70 and tackle 72 whereby the climber can be introduced up the drillhole 14. One end of the tackle is attached to the rear part 74 of the climber and passes over the block, which is fixed to the forward part 76 of the climber by means of a helical spring 78. In the starting position the climber is retained in the hole by the arresting means 80 thereof. When the tackle 72 is tensioned downwards the cone 82 presses out the arresting means 84 on the forward part 76, thus retaining the said forward part in the hole 14. The lower part 74 of the climber is drawn up as the helical spring 86 is compressed. When the tension on the line 72 is relaxed the arresting means 80 engage and the spring 78 draws up the cone 82. The spring 86 pushes the upper part 76 of the climber up the hole 14, and thereafter the tackle can be tensioned again and the cycle repeats.

The above embodiments can naturally be combined in a variety of ways. One type of climbing mechanism may be filled with primer and hence will be of single-use type. Another type of climber may incorporate a block and tackle which are carried up to the bottom of the drillhole together with the climber. Once the climber has been fixed in position it can serve, with the aid of the tackle, as a hoisting mechanism for cartridges or a tube. This climber too is, naturally, of single-use type.

I claim:

1. Device for the introduction of explosive in the desired place in a drillhole, characterized by a climber, which climbs on the walls of the drillhole and is equipped with locomotion means powered from a fluid pressure source and designed to propel the climber in the desired direction in the drillhole, said locomotion means including fluid pressure actuated expansion means associated with the climber and designed to press against the walls of the hole as to stabilize the climber in the hole and prevent it from falling downwards therein, a main valve arrangement positioned rearwardly of the climber relative to its direction of travel as the climber enters the drillhole to introduce an explosive thereinto, and operative to control the supply of fluid under pressure to said locomotion means, and means for providing an explosive charge in the drillhole forwardly of said climber, said valve arrangement including means for selectively moving said climber forwardly and backwardly, respectively, in the drillhole, said climber comprises two parts capable of motion relative to each other, enabling the climber to alternately extend and contract in the direction of the drillhole while said expansion means press against the walls of the hole, and further characterized in that said two parts are diposed to be positioned one forwardly of the other in the drillhole with the front part of said two parts of the climber engaging said explosive charge, and wherein said front part has thereon means detachable from the other of said two parts of said climber, whereby said other part can be withdrawn from the drillhole and reused.

2. Device as claimed in claim 1, characterized in that the two parts are telescoping.

3. Device as claimed in claim 1, characterized in that the two parts are, respectively, a cylinder and a piston reciprocating therein, and that the expansion means are fitted on the respective parts in order to press the said parts alternately against the wall of the drillhole as the said extension and contraction take place.

4. Device as claimed in claim 1, characterized in that the two moveable parts are connected by at least one helical spring to facilitate the movement of the parts towards and away from each other.

5. Device as claimed in claim 1, characterized in that the expansion means of at least one of the parts is designed to yield flexibly as the said part is propelled in the drillhole.

* * * * *